United States Patent [19]

Raimondi

[11] 4,267,562

[45] May 12, 1981

[54] METHOD OF AUTONOMOUS TARGET ACQUISITION

[75] Inventor: Peter K. Raimondi, Woodbridge, Va.

[73] Assignee: The United States of America as represented by the Secretary of the Army, Washington, D.C.

[21] Appl. No.: 19,069

[22] Filed: Mar. 9, 1979

Related U.S. Application Data

[63] Continuation-in-part of Ser. No. 843,295, Oct. 18, 1977, abandoned.

[51] Int. Cl.[3] ..... H04N 7/18

[52] U.S. Cl. ..... 358/109; 89/41 TV

[58] Field of Search ..... 358/109, 107; 89/41 TV, 89/41 L

[56] References Cited

U.S. PATENT DOCUMENTS

| | | | |
|---|---|---|---|
| 3,737,120 | 6/1973 | Green | 244/3.17 |
| 3,793,481 | 2/1974 | Ripley et al. | 358/107 |
| 3,879,728 | 4/1975 | Wolff | 244/3.17 |
| 4,004,487 | 1/1977 | Eichweber | 89/41 TV |

*Primary Examiner*—Joseph A. Orsino, Jr.
*Attorney, Agent, or Firm*—Nathan Edelberg; Milton W. Lee; Max L. Harwell

[57] ABSTRACT

A method of target acquisition and lock-on-launch strike capability of self guided explosive canisters, such as imaging missile systems and imaging artillery projectiles, by launching an imaging sensor platform over the battlefield area and transmitting imagery of the battlefield to an image processing computer system and an image receiving on-board microcomputer. The sensor platform may be an artillery television camera fired over the battlefield and parachute deployed, or an airlift sensor platform aboard a helicopter or the like. The image processing computer system is comprised of an automatic target cueing system and CRT display in which the system displays cued targets on the CRT. The method has an important man-in-the-loop, as a crew-chief, who examines the cued targets on the CRT and eliminates false targets, such as a bush or rock, and annotates selected targets to be struck by the explosive canisters. The self guided explosive canisters have electrical connectors between the microcomputer system and the computer system to directly receive and store thresholded digital target maps of the battlefield targets therein from the computer system. After launch of the canister, the microprocessor directly receives sensed imagery from the battlefield, compares and matches the sensed imagery with the stored digital target map, and guides the explosive canister to its designated target.

10 Claims, 24 Drawing Figures

TEMPLATE

SENSOR IMAGE

METHOD OF AUTONOMOUS TARGET ACQUISITION

The invention described herein may be manufactured, used, and licensed by the U.S. Government for governmental purposes without the payment of any royalties thereon.

CROSS-REFERENCED TO RELATED APPLICATIONS

This application is a continuation-in-part of parent application Ser. No. 843,295, filed Oct. 18, 1977, now abandoned entitled "Method of Target Acquisition and Strike Capability for Artillery Batteries," by the same inventor.

BACKGROUND OF THE INVENTION

The general field of science of the present invention is in image processing, pattern recognition and electro-optical sensors used in target acquisition and strike capability.

Artillery battalions have previously proven to be an effective deterrent against advancing armies. Their projectiles are low cost and their effects against troop movements are devastating. At the present, advancing troops are transported within artillery ranges by armored personnel carriers (APCs) and are supported by the close range fire power of tanks. The use of APCs have led to the development of armor piercing artillery as well as illuminating rounds to aid the forward observer in sighting enemy movement. The probability of a random fire artillery hit upon an armored moving target is however almost zero. Also, the forward observer is placed in the dangerous position of being detected by enemy scouts.

To increase the number of hits on armored targets, the forward observer has been equipped with a laser designator to mark appropriate targets. A launched laser seeking shell can then find and destroy these marked targets with almost 100% accuracy. However, since the designating laser is a visible source, the forward observer has now disclosed his position to enemy forces and is in danger of being killed. In all these cases, the weakest link is the human forward observer.

To alleviate the problem of the forward observer being in a vulnerable position, an artillery television (ATV) has been used to sight the enemy movements. The ATV is comprised of a TV camera and transmitter mounted to a parachute, all contained in a standard illuminating round. When fired in a path over enemy territory, the chute is deployed after a known delay. The slowly descending TV camera transmits pictures of enemy forces or vehicles back to a receiving display system at a ground station. The ATV camera system is also used to detect the impact of high explosive rounds during actual firing so that artillery correction may be correlated at the receiver station.

Even though the ATV camera may be substituted for the forward observer and as an artillery correction medium, a problem still exists in the ability to hit hardened moving targets such as APCs and tanks. Even if artillery correction were perfect, chances are that the target has moved from the originally observed location by the time the artillery round arrives.

Problems also exist in firing missiles from airborne stations, such as advanced attack helicopters (AAH) or airplanes, over the outer perimeter of enemy terrain where the enemy may quickly return fire to the aircraft. A need to minimize the exposure time of the aircraft to enemy fire, yet retain accuracy of direct hits, is solved by the present inventive system. The same is true for the artillery projectiles since they employ a remotely piloted vehicle (RPV) with a laser designator to provide target annotation for the projectile sensor. Both the RPV and the AAH contain expensive sensor platforms that should be preserved. The present inventive system will be applicable to a number of imaging missile systems, such as the HELLFIRE, MAVERICK, etc and imaging artillery projectile, such as the cannon launched guided projectile (CLGP) employing the ATV or infrared sensor.

SUMMARY OF THE INVENTION

The present invention involves an image processing computer system comprising means for solving the target acquisition and strike capability problem. One means involves a computer having an area correlator which uses TV imagery to program a "SMART" artillery shell. The artillery shell, for example, is able to make decisions and alter its flight path from a purely ballistic trajectory, and especially in the last part of the trajectory close to the general area where a target, designated by the crew chief, is located. It should be noted that artillery projectile fire can normally be held to within a general area, called a basket diameter, of 25 meters. After an area correlator within the shell narrows the basket diameter, an automatic target cueing system in another computer, i.e. an on-board microcomputer, takes over to direct the shell to the designated target. The original ballistic trajectory may be called Path A of the shell and the top third of the trajectory, which is the portion of the trajectory effected by the area correlator, may be called Path B of the shell. Path C of the shell is the automatic target cueing controlled portion of the trajectory, which is the last third of the trajectory in which the shell is automatically guided to target impact. The present inventive system may be used equally as well in missile munitions in a lock-on-after-launch mode of operation as discussed herein below.

One problem with automatic target cueing, Path C, is that a bush or rock the size of a typical target may be designated as an enemy target by the built-in target extractor of connected components in the target cueing system, thus expending an expensive shell on a useless item. Also, in the case of multiple targets, several shells may strike the same dead hulk. Previous development of target cueing systems have indicated high probabilities of false alarms, i.e. non-targets designated as targets, as well as the need for bulky computer hardware. The present inventive method comprises a target cuer method of target acquisition by the imaging processing computer system automatically highlighting a target, along with an important man-in-the-loop operation of either eliminating targets by not assigning an explosive canister or annotating selected targets to be hit. Good references to a target cueing method of target acquisition and target classifying by highlighter graphics markers is included in two booklets in the form of Technical Reports with both entitled "Algorithms and Hardware Technology for Image Recognition," by D. L. Milgram, A. Rosenfeld, T. Willett, and G. Tisdale with one dated July 3, 1976 and available as reference number ADA 035039 and another dated Oct. 31, 1976 and available as reference number ADA 035038 through Defense Technical Information Center, Cameron Station, Alexandria, VA.

In the use of airborne sensor platforms of the present method, target acquisition scenarios for lock-on-after-launch of airborne fired rockets or missile munitions involve exposing the sensor platform, as an example, the AAH having a rocket platform or a conventional missile carrying fighter aircraft for a very short period of time prior to firing the rocket or missile munition. The AAH is very good at popping-up over a battlefield area, or an obstacle, such as a hill, at the outer perimeter of the enemy area, to take one frame of a direct view picture of the battlefield and then pops-down before the enemy has time to react. A crew chief on board the AAH analyses the sensed image which is displayed on a CRT screen of the image processing computer system. It should be emphasized that the targets visible on the CRT are automatically segmented and the target extracted and classified by automatic target cueing algorithms within the image processing computer system. However, it remains for the crew chief to eliminate any of these targets that are false targets and to annotate selected targets by use of a light pen to project a narrow light beam on the light sensitive screen of the CRT. The crew chief may also annotate targets that are not produced by the target cueing algorithms. These targets may be designated as target points referenced to clutter, herein known as cued-on-clutter. The sensed image and the annotated target form a digital target map that is stored in a digital map storage random-access-memory (RAM) which may also be a read-only-memory (ROM), within a microcomputer system on board the imaging self guided explosive missile canister via a direct electrical connector between the image processing computer system and the on-board microcomputer prior to missile firing. The connector breaks away once the missile is fired, and the missile is guided according to the stored digital target map and the sensed image that is received by the image sensing equipment in the missile canister after firing since the image sensing equipment is uncovered immediately at the time of firing. However, if the helicopter for some reason remains in direct view of an enemy area while obtaining the designated target, the imaging system in the missile canister may be uncovered prior to firing in which case the missile will be sensing the enemy area at the time the missile is fired and will be guided directly to the target therefrom. However, when the AAH has popped-down behind an obstacle after the initial frame of the imagery has been taken, the missile may even be fired toward the obstacle as long as the target is in front of the traveling missile and directly over the obstacle since the missile is capable of having a separate program therein that commands the missile to go over the obstacle and then tilt over toward the enemy target area whereupon the missile imaging system begins receiving sensed images of the enemy target area for comparison with the stored digital target map. The sensed image is digitized by the microcomputer analog to digital converter and the digital target map is mathemetically rotated for comparison with the sensed image whereupon the microcomputer sends signals to the guidance system of the missile to guide the explosive canister to an annotated target, or possibly to a moving target which would be automatically detected by the on-board microcomputer if no perfect match of the digital target map and the digitized image can be achieved under those circumstances and if the microcomputers is programmed to pick up and follow on a moving target if there is no match. An explanation of the mathematical algorithm used in matching the digital target map model stored in the microcomputer to the continuously sensed image may be found in an article entitled, "Feature-Based Scene Analysis and Model Matching" by C. S. Clark, A. L. Luk, and C. A. McNary in a book entitled, Pattern Recognition and Signal Processing edited by C. H. Chen and published by an international board of publishers in conjunction with NATO Scientific Affairs Division by Sijthoff and Noordhoff, Alphen aan den Rijn, The Netherlands and Winchester, Mass. This article teaches the algorithm development in producing a digital target map scene model by contrast-edge extraction, filtering, line-segment generation, and line linking. This article was published in 1976.

Generally, the image processing computer system receives the sensed images and the crew chief sends target annotated signals by wire link to the missile on-board microcomputer whereupon the wire link is broken when the missile is fired from the aircraft but not until the necessary digital target map, threshold gray level values, moving target vectors, cued-on-clutter information, etc has been entered into the memory of said on-board microcomputer digital map storage RAM. Any target point where it appears that a moving target would be located after a short delay in readying the explosive canister for launch may be annotated by the crew chief after analysis of a target moving in a straight line or vector, herein referred to as moving target vector, and designated in reference to clutter, i.e. the cued-on-clutter as stated herein above. Three books in the form of Technical Reports that expound on software and hardware implementation of clutter recognition and classification, or cued-on-clutter, and symbol generation are available through Defense Technical Information Center, Alexandria, Va. One book is entitled, "FLIR Image Analysis with the Autoscreener Computer Simulation," dated February 1976 and available as reference number ADA 022755. Another book is entitled, "A Discussion of Hardware Implementation and Fabrication for an Automatic Target Cueing System," dated Jan. 31, 1977, and has reference number ADA 041907. The third book is entitled "Proceedings: Image Understanding Workshop," prepared by Lee S. Baumann in April 1977 and available as reference number ADA 052900. Due to necessity, the descending ATV is normally radio linked to the image processing computer system.

The cued-on-clutter targets are not automatically produced by the target cueing algorithms but are detected by the crew chief and the decision could be to fire a canister toward a non-cued target. The target might be, for example, a freshly bulldozed area which is not picked up by the segmentation, i.e. target cueing, section of the target cueing algorithms. The crew chief may use the light pen to designate an impact point in space rather than a target object. This impact point is found by its spatial relationship to stationary objects such as roads, forests, buildings, rivers, etc wherein this cued-on-clutter information is automatically stored in the digital map storage RAM in the microcomputer. These stationary objects give good matching with the sensed image obtained by the canister imaging system.

By the image processing computer system taking the sensed image, or picture, received from the TV and performing target cueing algorithms on the image, the man-in-the-loop is able to designate targets by use of a light pen. The target cueing algorithm is performed on the sensed image by application of a segmenter to find thresholds and create a binary image that is fed into an object extractor of a connected components portion for calculating the bounds of objects, or targets and then fed into a target classifier. The target classifier determines if a particular object in the sensed image is the same size, shape, height to width ratio, etc of typical enemy target. By creating a digital target map of the cued image, the clutter as well as the targets may be used as references for aligning the high explosive shell to a proper target strike path. A crew chief, who is the above mentioned man-in-the-loop, is the final designator of the actual strike target. All probabilities of false alarm, i.e. clutter object designated as a real target, are reduced to near zero or to the effectiveness of the crew chief. Another advantage of the present method is the fact that a digital target map is a simple structure. Since the digital target map is burned in the self guided explosive canister (the artillery projectile or the missile munition) a comparison method (pattern matching) between the digital target map and the sensed image is performed in the on-board microcomputer and is able to match the various individually designated or cued components to the sensed scene image received by imaging equipment in the canister as the canister proceeds to its target. The on-board microcomputer controls a guidance system on the canister to minimize positional differences between the sensed scene image and the reference template map. Moving target vectors in the digital reference map account for motions due to the time displacement between the reference template map and the sensed scene image. The vectors indicate the direction a particular target vehicle was traveling when it was either photographed from various altitudes by the descending artillery TV camera or by comparison of two or more images separated by a very small time frame when photographed from a stable sensor platform thereby predicting the targets new location along said moving vector as canister flight time increases. Another alternative would be if the digital target map matches the sensed scene image perfectly except for one object, then the one object that has moved must be the target and the on-board microcomputer automatically activates the guidance system to guide the canister to this target.

The inventive method embodies a system which is comprised of the functions of an image processing computer system and interconnected microcomputer on-board the canister with a man-in-the-loop for annotating targets to the computer that the computer cannot totally determine. The microcomputer is purposely made less complex since its functions are limited due to the high speeds of the explosive canisters. The microcomputer does however receive the digital target map reference data from the image processing computer system prior to launch for comparison with the active sensing image obtained by its imaging system and provides guidance correction signals after launch due to the difference in the sensed image and the stored digital target map. The crew chief has a light pen for annotating targets on the screen of the CRT display, or alternatively may designate targets, threshold levels, and moving target vectors by a keyboard hook up to the microcomputer digital target map storage memory. The preferred method that the observer uses to annotate additional targets is by use of the light pen to indicate a target on the light sensitive CRT screen and then assigns the explosive canister to the target by the keyboard by commanding the image processing computer system to formulate one of several digital target maps into the memory of the microcomputer of the assigned explosive canister just prior to firing. The explosive canister is fired in the direction of the target and may have to maneuver over the obstacle, as mentioned above, but will begin terminal guidance as soon as the sensed picture image is received for comparison with the reference digital target map. This autonomous target acquisition and strike capability system totally eliminates the need for a human forward observer with any laser designating devices.

The present method may also be applied to various glide bomb munitions, fire and forget missiles, homing systems, automatic pilot systems, and spacecraft systems were drones must locate base stations when radio communication is impossible and other areas where some terrain has been pre-photographed and a device must follow that same previous path.

DETAILED DESCRIPTION OF THE PREFERRED EMBODIMENT

Figure 1:
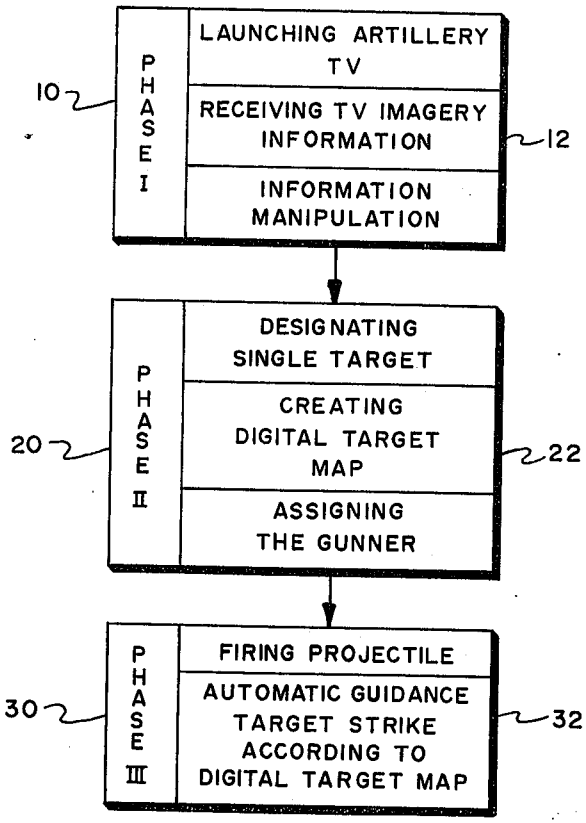
FIG. 1 is a schematic block diagram, generally illustrating the steps of the present method of target acquisition and strike capability.

FIG. 1 shows, in block diagram form, the three phases in the present ATV camera method of target acquisition and strike capability for artillery batteries. Phase I, represented by block 10, is comprised of the steps on the numeral 12 side of block 10 of launching the ATV camera and firing spotter artillery battery rounds, receiving the TV imagery information, and manipulating this information. All of these steps will be elaborated on herein below, and especially with reference to FIGS. 2, 3, 4, and 5. Phase II, represented by block 20, is comprised of the steps, on the numeral 22 side of block 20 of designating the target, creating a digital target map in a shell, and assigning the gunner by a crew chief 55, shown in FIG. 3, using a light pen 56 and keyboard 57. These steps are discussed therein below with reference to FIGS. 3, 6, and 8 through 22. Phase III, represented by block 30, is comprised of the steps of the numeral 32 side of block 30 of firing the shell and the automatic guidance of the shell to a target according to the digital target map in a microcomputer on-board the shell. FIG. 7 illustrates the environment in which the Phase III steps are accomplished.

Figure 24:
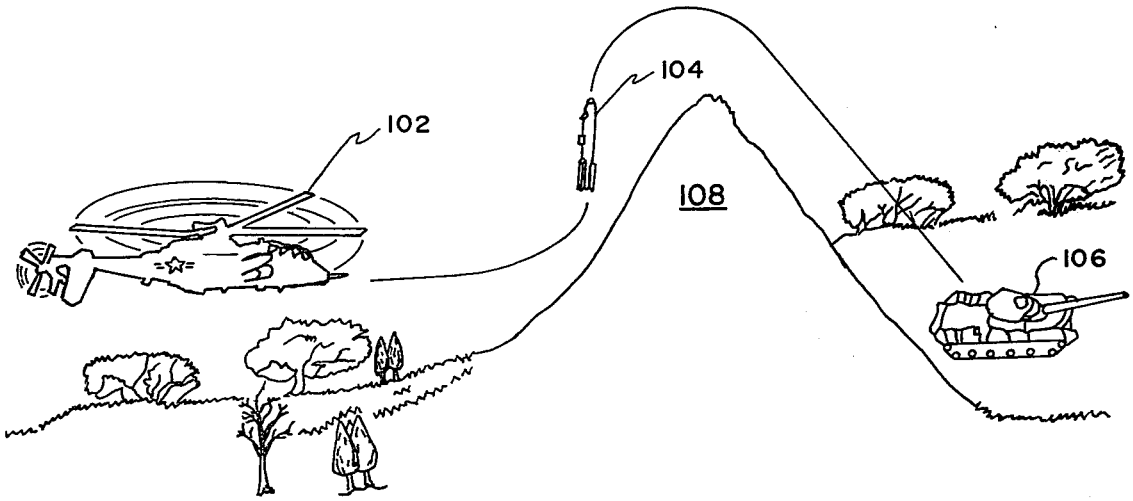
FIG. 24 illustrates a perspective view of the AAH firing a missile munition over an obstacle.

FIG. 24 shows a perspective of an AAH 102 capable of having a rocket platform with missile munitions canisters thereon. The helicopter 102 is shown as just having launched an imaging self guided missile munitions canister 104 therefrom that has a guidance capability for going over an obstacle 108, such as a hill, and then tile over toward an enemy area having for example a tank 106 therein. Canister 104 will sense the image and feed the sensed image to the on-board microcomputers for matching to the digital target map stored therein. The AAH first pops-up over the obstacle 108 to expose the sensor platform for sensing enemy targets by electro-optical sensors, such as the U.S. Army's forward looking IR system, and having TV type image producing means thereon that takes at least one image frame of the enemy area then the crew chief orders the AAH to pop-down below the obstacle before the possibility of drawing return fire from enemy guns. After the imaging self guided explosive canister 104 is fired the canister imaging system obtains the enemy target, represented as tank 106, either after going over the obstacle and tilting down or if in direct view of target 106 by the AAH poping back up to launch the canister and reaquire the target after initial launch transient vibrations.

Figure 14:
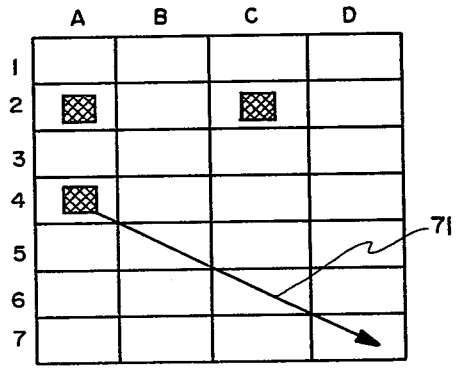
FIG. 14 indicate a template map that is programmed in the microcomputer in which a moving target vector indicates a target movement.

When the AAH pops up over the obstacle, or up considerably over the tree top level, to record a sensed image of the enemy area, there may be more than one frame recorded separated in time, but not in space, to derive any target movement indicated by displaced target images on subsequent frames. It should be noted that the reason the images are not separated by location is because the sensors aboard the sensor platform are locked to a fixed position on the ground regardless of how the sensor platform moves by motion of the AAH. The sensor platform is locked in a fixed position by means of stabilized gimbals and inverted navigation sensors. Therefore, since the incoming sensed imagery is registered, the target cueing algorithms can derive those objects which moved when two images are compared. These moving target vectors, which are comprised of several spatial locations, or xy points as in the digital target map 64 of FIG. 6 and several spatial locations as in 72 of FIG. 6 plus a vector slope 71 of FIG. 14, are transferred to the self guided explosive canister microcomputer digital map RAM 90 along with the thresholds and the digital target map.

Figure 3:
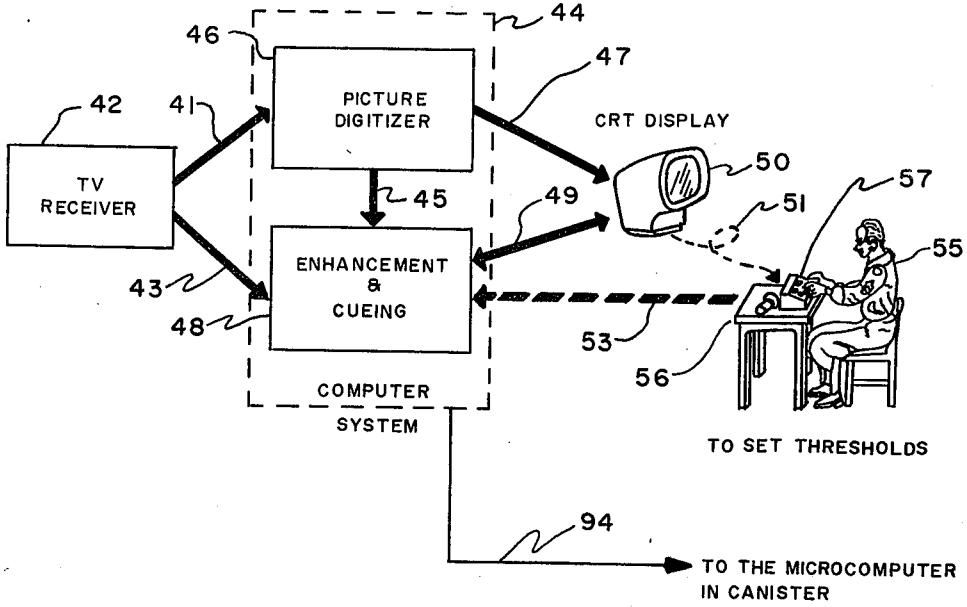
FIG. 3 shows the image processing computer system in partial block diagram of the imagery acquisition phase from the ATV camera.
Figure 4:
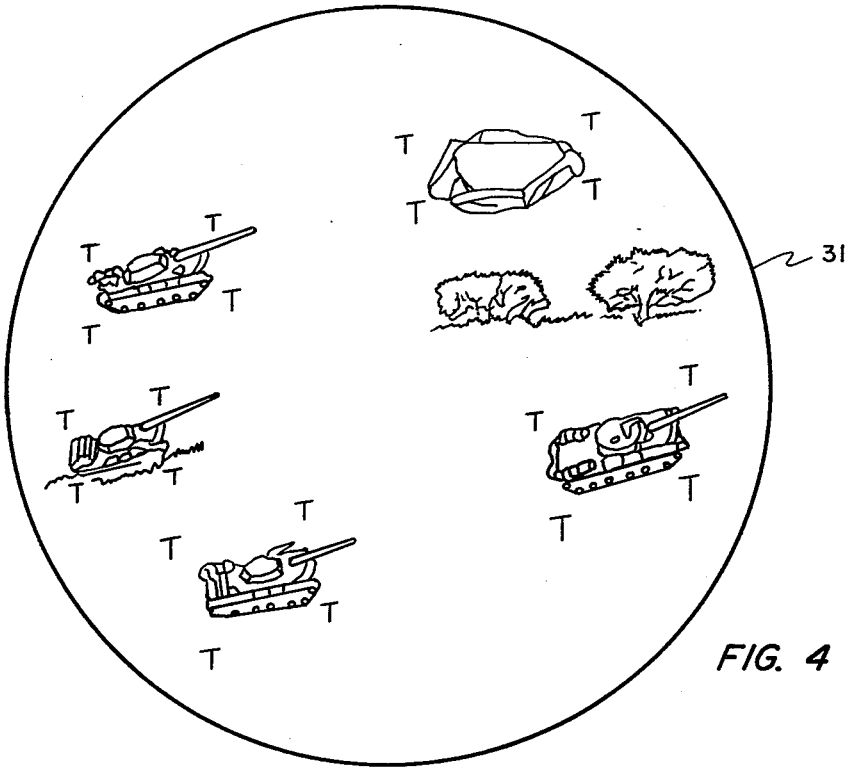
FIG. 4 shows a typical cathode ray tube display after targets have been cued by the letter T.

Refer now to FIGS. 3, 4, 6, 17 through 20, and 23 for a discussion of the function of the present image processing computer system, shown by FIGS. 3, 4, 6, and 17, and its interrelation with and the function of the imaging self guided explosive on-board microcomputer system, shown by FIGS. 18, 19, 20, and 23. It should be noted that even through the crew chief 55 is shown in a typical ground station environment for manipulating the image processing computer system in the specific method of programming artillery projectiles, the identical image processing computer system is used to program the missile munitions on a helicopter or airplane. In both methods, a TV receiver 42 receives the sensed images from either the ATV or from a sensor platform on the helicopter or airplane. The TV image is digitized by picture digitizer 46 and is the same digitized TV image that is displayed on the light sensitive screen of the CRT 50, in which the screen is light. Simultaneously with the digitizing of the TV image, enhanced in brightness and gain and the enemy targets are automatically cued by being thresholded, extracted, classified, and highlighted by the enhancement and cueing circuit 48. The cueing portion of circuit 48 is performed by automatic target cueing algorithms. These cued targets in 48 are applied to the CRT 50. The classified and highlighted targets may be as shown in FIG. 4 where the targets are classified according to size and shape as a tank and are highlighted by the letter T on four edges. However, plainly the classified target in the upper right is a rock instead of a tank. The crew chief functions as the man-in-the-loop to eliminate that rock as a target such that the image processing computer system will not automatically program one of the microcomputers as to the rock being an enemy target.

Figure 8:
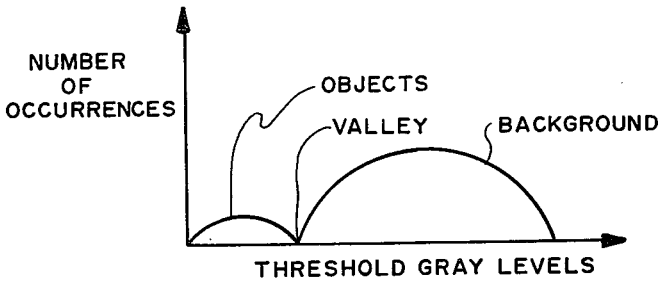
FIG. 8 shows target cueing curves that define the number of levels of objects on a background.
Figure 9:
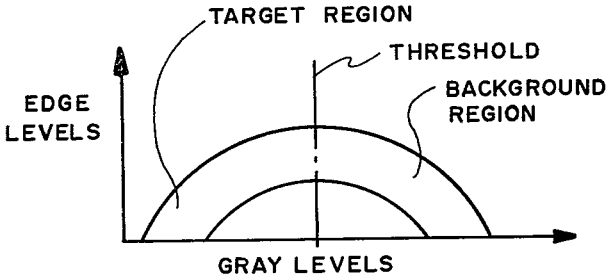
FIG. 9 are curves that indicate thresholding of targets based on edge levels.
Figure 17:
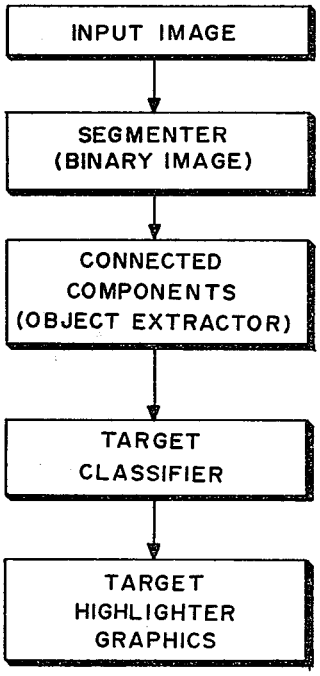
FIG. 17 illustrate in block diagram form the target cueing algorithms of the image processing computer system.

The flow chart for the automatic target cueing step in circuit 48 of FIG. 3 is shown by flow chart in FIG. 17. The input image from the TV receiver 42 is first segmented by the segmenter, i.e. a binary image is produced where the background is one gray level and the targets on the background are another gray level. The segmenter uses the technique described herein with reference to FIGS. 8 and 9, i.e. the number of occurrences in a numeral count of gray levels versus the number of discrete gray levels available over an image total dynamic range as shown by FIG. 8 and the edge levels which is the same range as the gray levels except representing the amount of transitions between two picture elements rather than each of its discrete valves as shown by FIG. 9. There are no true units for these valves. The next step is that of calculating the bounds of targets by connected components to extract the target, or object. The next step is that of classifying the target as to size, shape, height to width ratio, etc of typical enemy targets such as tanks, or truck that may be classified as such. The classified targets are highlighted by graphics, such as the letter T, as shown by FIG. 4, or TR for a truck. When a target is classified and highlighted and presented on the CRT the crew chief may then annotate the target to be hit by one of the imaging self guided explosive canisters by projecting a narrow light beam from a light pen onto the target as displayed on the light sensitive screen of the CRT. It should be noted that between the steps as shown in block diagram form in FIG. 17 that the information is directly connected to the microcomputer system of FIG. 18 by connector 94. The information is applied directly to the digital map random access memory 90. It should also be noted that when the canister is launched, after the RAM 90 has already been stored with the digital target map, the threshold values and the moving target vectors, connector 94 is broken away. The program built in program storage read-only memory (ROM) 88 retrieves the stored digital target map out of RAM 90 as needed.

Figure 6:
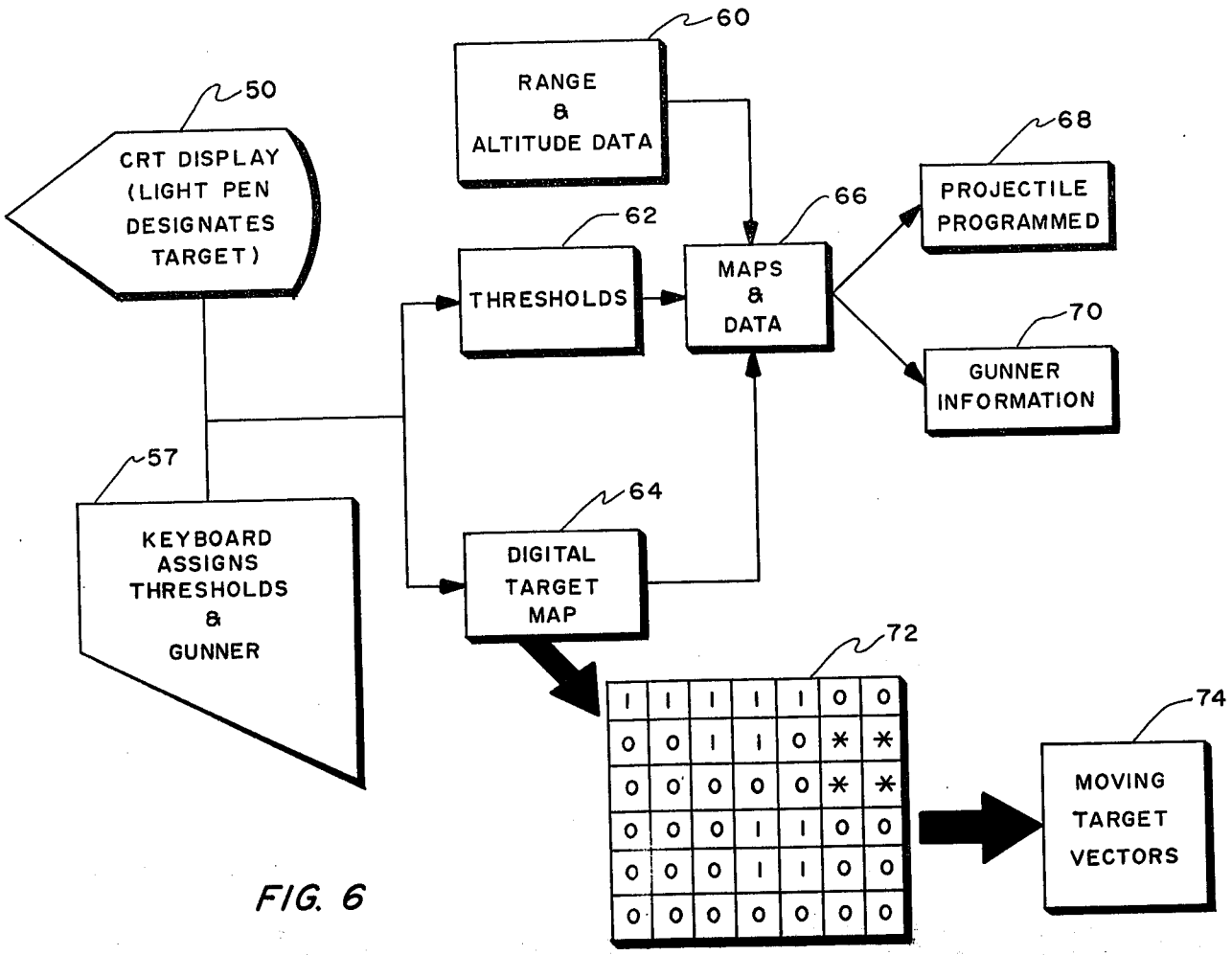
FIG. 6 illustrates the target designation phase in which the digital target map is produced and the projectile is programmed.
Figure 7:
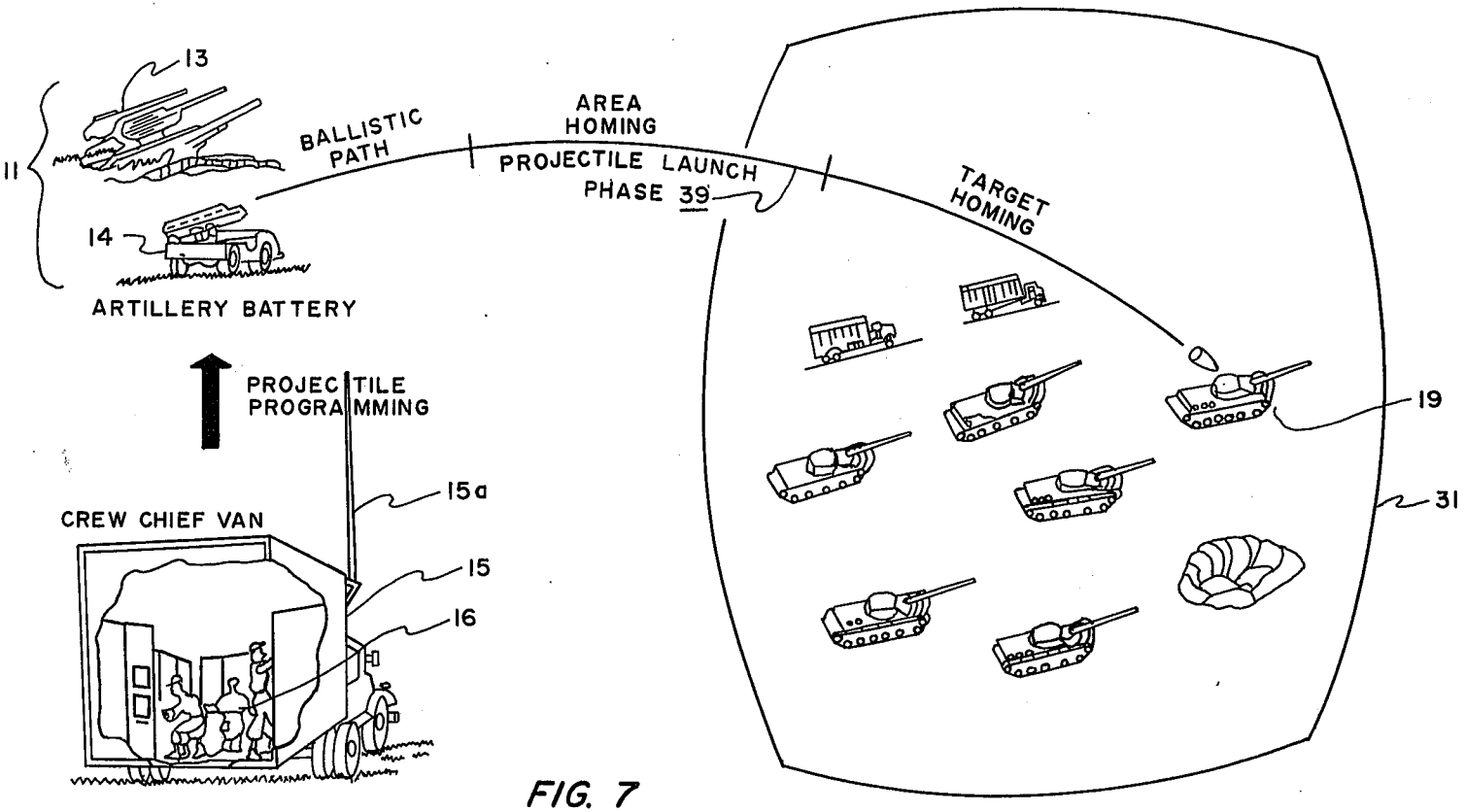
FIG. 7 illustrates the projectile firing and self guidance to target phase.

FIG. 6 illustrates the important step of the crew chief man-in-the-loop annotating targets by a light pen or by keyboard wherein an xy matrix 72 of the digital target map 64 is shown where the asterisks are representative of a moving target vector within the digital target map. The crew chief assigned thresholds 62 and the digital target map 64 are simultaneously applied to a maps and data junction 66 along with any range and altitude data 60 for supplying gunner information 70 and for programming an imaging self guided canister 68 wherein this programming data is sent to the digital map storage RAM 90 in the on-board microcomputer system.

Figure 18:
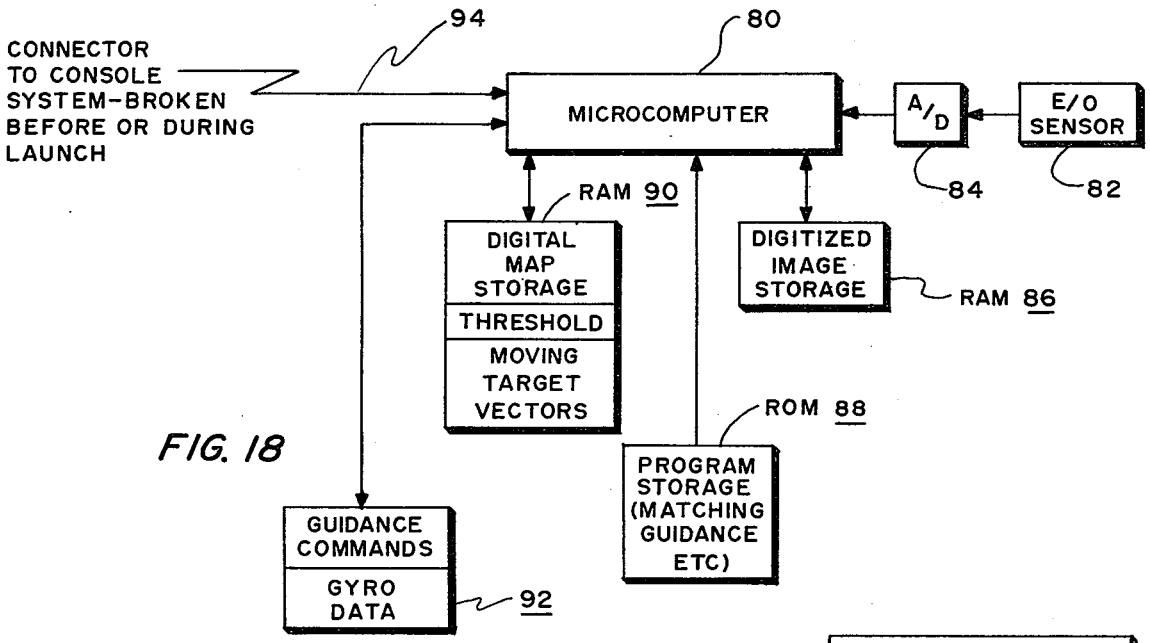
FIG. 18 shows in block diagram form the explosive canister on-board microcomputer and peripheral equipment related thereto.
Figure 23:
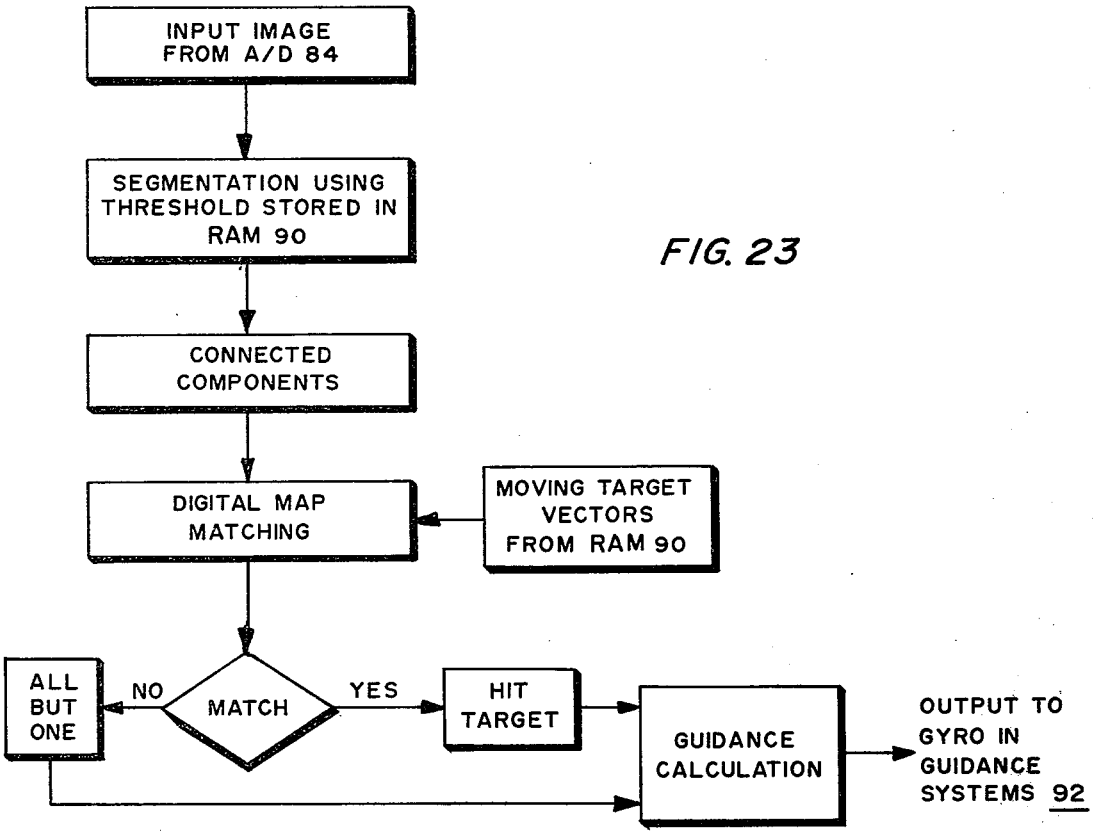
FIG. 23 shows a flow diagram of the program in the on-board microcomputer.

FIG. 18 illustrates the functional block diagram of the microcomputer system and FIG. 23 illustrates a flow chart of the steps performed by the program stored in ROM 88 memory that is manipulated by microcomputer 80. The sensed image obtained by the on-board imaging system is represented by the electro-optical sensor 82. This sensed image imaging system functions the same as the TV imaging system but is preferably made of microcircuitry to keep its size as small as possible. The sensed image, which is in analog form, is converted to a digitized image by the analog/digital converter 84 and the digitized image is temporarily stored in a random-access-memory (RAM) 86. The built in program storage ROM 88 stores and retrieves the sensed images from RAM 86 as needed.

Look now at FIG. 23 along with FIG. 18 for the programmed memory schedule of the microcomputer system. The major function of the microcomputer 80 is in accepting the digital target map with the crew chief thresholded annotated targets directly from the image processing computer system over lead 94 and storing this data in a RAM 90, and receive the active sensed images from the canister imaging electro-optic sensor 82 for digitizing by analog digital converted 84 and temporarily storing in RAM 86 then rotating the digital target map in RAM 90 according to a program stored in ROM 88 for matching with the sensed images as withdrawn from RAM 86. After matching, the microcomputer sends guidance commands to a guidance system 92 according to the imagery and matching criteria including any imaging system camera gimbal data. Look now at the flow chart of FIG. 23. The microcomputer 80 controls the input sensed image from the analog/digital converter 84 that is stored in RAM 86. The next step is retrieving the segmentation using a known annotated target threshold of the digital target map stored in RAM 90. The next step is calculating the bounds of the target by use of connected component algorithms. The moving target vectors and cued-on-clutter information are also included in the digital target maps. The microcomputer 80 further manages memory stored in the program storage ROM 88 that is associated with the matching of the digital target map and the digitized active imagery. If there is match as indicated by the YES at the output of the decision block, a hit target command is given to a guidance calculation circuit which is fed to a gyro in the guidance system to guide the explosive canister to maintain the match and to proceed to the target. If there is no match indicated by NO at the output of the decision block, this data is sent to an "all but one" matching circuit whereupon the unmatched data sends signals to the guidance calculation circuit for instructing the gyro in the guidance systems 92 to pursue the one unmatched target which has to be moving, and thus is assumed to be an enemy military target.

Figure 19:
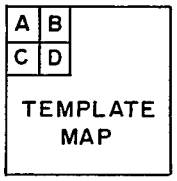
FIGS. 19 and 20 show a small window of grey levels respectively in the template map and in the sensed target images in the microcomputer.
Figure 20:
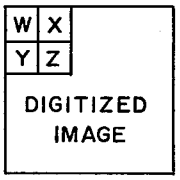

As stated before, the microcomputer 80 rotates the digital target map to match with the digitized sensed image. FIGS. 19 and 20 respectively illustrate a small window of gray level stored in a small portion of the digital target map, or template map, as stored in RAM 90, and the same small window of the digitized image, as stored in the RAM 86. This is simply matching only a small portion of the overall scene because it is much cheaper to implement than matching the entire scene. It is believed that three of these small windows strategically spaced over the microcomputer RAM 90 and the digitized image are sufficient to provide a good tradeoff for the accuracy needed at the cheapest price. It should be noted that each of the A, B, C, and D areas indicate separate gray levels within their overall window. Also, each of the W, X, Y and Z areas within the digitized image in RAM 86 should be matched respectively with the A, B, C, and D areas. The microcomputers uses mathematical algorithms to rotate the small window or windows the same as it would in rotating the entire map. Once the amount of linear shift or rotation between the respective pairs of A-W, B-X, C-Y, and D-Z is determined on the small windows, a global modification of the digital target map by the determined amount will distort the entire digital target map to appear in the same perspective as the sensed imagery. If the image distortion is too large to perform correlation then a more complex level of matching must be performed.

Figure 21:
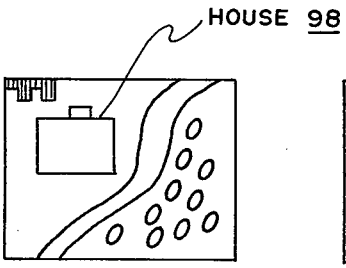
FIGS. 21 and 22 represent clutter images wherein the observer may annotate a target from the sensor image in FIG. 22 and is applied to the template map of FIG. 21.
Figure 22:
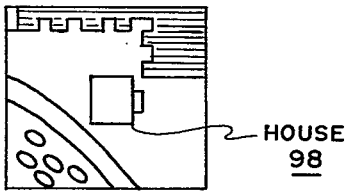

FIGS. 21 and 22 are merely presented to illustrate how difficult it might be for an actual human view of a scene as shown by FIG. 21 versus the same scene that is 90° out of phase as presented by the sensor imaging system in FIG. 22. This same scene could possibly be matched easier by the programmed microcomputer than by the human viewing the scene and then correcting the canister flight path by remote control commands.

Many image processing systems have the capability to convert an analog TV image into a two dimensional digital (numeric) matrix, i.e. by digitizing or by analog to digital conversion, and to convert the digital matrix back into a continuous video image, i.e. digital to analog. Some of these systems that may be used is the present image processing computer system are De Anza, $I^2S$ Model 70, or Comptol. In these systems, once an object within an image has been annotated by the crew chief using a light pen, or possibly a track ball and joy stick, the system inherent computer records the XY position of the indicator. The target at this position would have its digital gray level value within the image matrix changed, or the XY position value recorded in a separate memory, to indicate to the microcomputer that this is the target position, or the clutter object. Also residing in this separate memory, which is RAM 90, are the threshold gray levels needed to segment the target objects off the background as was determined by the image processing computer system. This allows the microcomputer to be a simple computer since segmentation is the most "costly" of the target cueing processes. These thresholds are not combined with the digital target maps but are used by the microcomputer to convert the incoming realtime video at 82 into digital images or maps by the analog/digital converter 84 to be compared with the stored digital target map in RAM 90.

Figure 2:
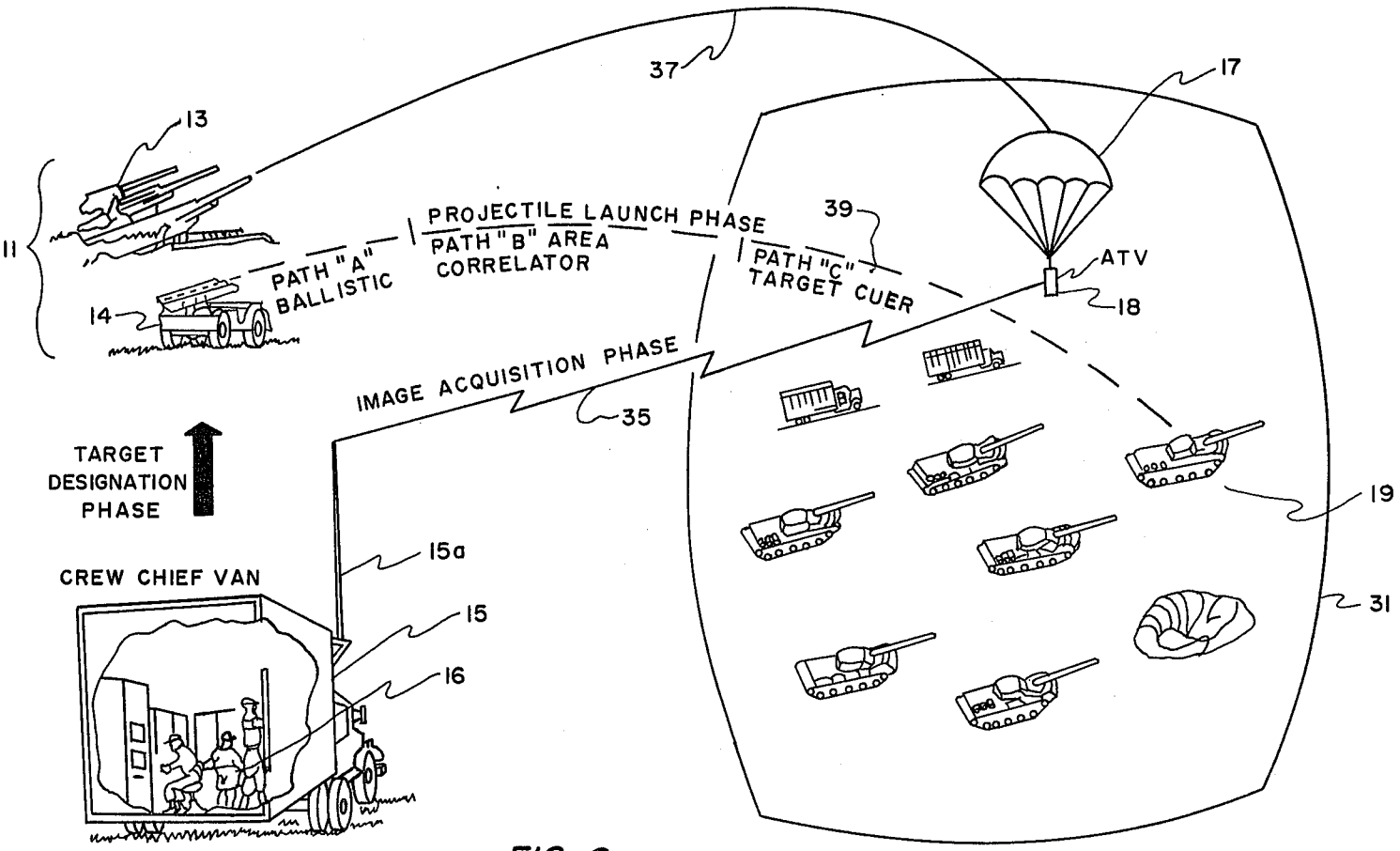
FIG. 2 illustrates a schematic perspective of the ATV camera method of target acquisition and guidance.

Look now at FIGS. 2, 3, 4, and 5 for a discussion of the Phase I operation of FIG. 1. An ATV camera 18 mounted to a parachute 17, is fired from a TV artillery battery 13 over a battlefield area 31. The ATV 18 is contained in a standard illuminating round which is launched from a heavy artillery gun of battery 11, i.e. TV battery 13, over the battlefield area. The parachute and ATV camera are deployed from the illuminating round after a timed delay and begin a slow descent toward the ground of the battlefield area. At about the same time that the ATV camera is deployed, spotter rounds of cloud charges are fired by all of the gunner artillery batteries 14 to coordinate all of the gunners to a central reference. Each of the gunner artillery batteries are preferably fired in slow sequence. After firing the spotter rounds, an offset is locked into each gun so that an observer, in this case a crew chief, only knows the point of impact and relays such information to each gunner (or gun crew) regardless of their position. This procedure is repeated every time the battery 11 is moved to a new position. Also, many ATV's may be fired to coordinate the spotter rounds. Path 39 of FIG. 2 represents the path of projectile launch paths from batteries 14. In the method of coordinating all of the gunners to a central reference, the crew chief may use an image processing computer system 44 to calculate the position, i.e. altitude and attitude, for the particular gunner he is addressing. Alternatively, an offset may be locked into each artillery battery wherein the crew chief simply relays the point of impact to each gunner regardless of the position of the gunner.

Figure 5:
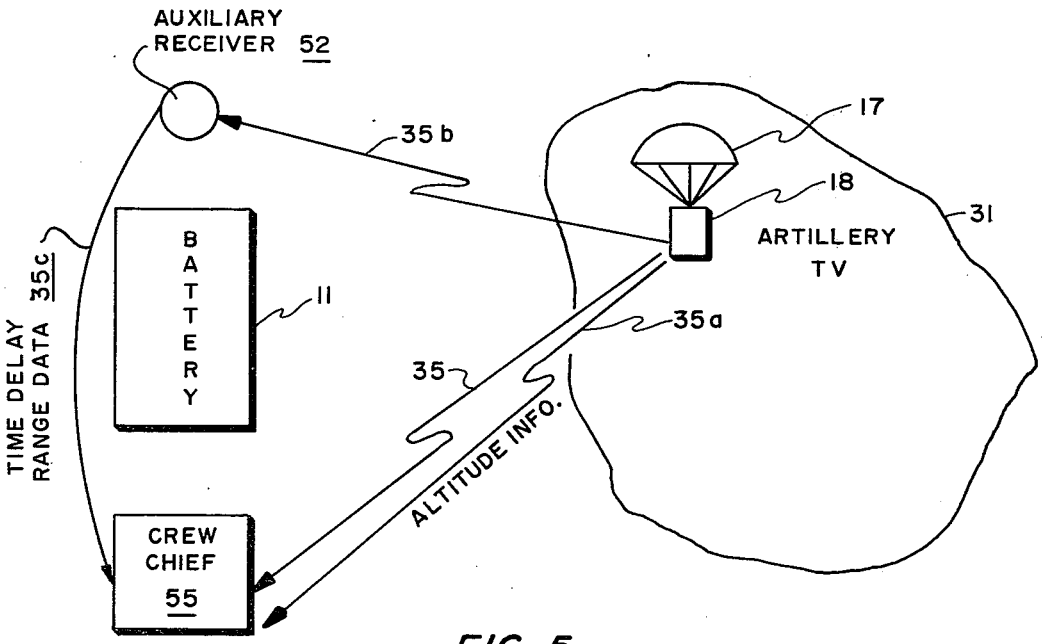
FIG. 5 illustrates a means of altitude determination and range data of the ATV camera.

During the time of the descent, the ATV camera is continuously transmitting imagery of the several artillery battery spotter rounds and enemy forces, on the battlefield back to a receiving display system at a ground station, represented as a crew chief van 15. The crew chief may be represented by numeral 16. These enemy forces may, for example, be in the form of tanks, trucks, etc. of the heavy equipment variety. The imagery, transmitted by high frequency waves and represented by numeral 35, is received by antenna 15A on the van. The high frequency waves are fed to a TV receiver 42, of the receiving display system as shown in block diagram form in FIG. 3. The outputs from the TV receiver 42, represented as numerals 41 and 43, are fed respectively to a picture digitizer 46 and enhancement and cueing circuits 48 of an image processing computer system, comprised of computer system 44, the CRT display 50, keyboard 57, links 47, 49, 51, and 53, and light pen 56 used for annotating targets on CRT 50. Picture digitizer 46 is an analog to digital converter, shown in FIG. 18 as block 84. The enhancement portion of circuits 48 is comprised of gain and brightness controls, and the cueing portion of circuits 48 is comprised of the above mentioned function of performing target cueing algorithms, i.e. taking an input image, feeding this input image to a segmenter to produce a binary image, and applying a target extractor in a connected components portion, feeding the extracted target into a target classifier, performing target highlighter graphics on the classified target and then applying to CRT 50 by link 49. The digitized picture of the image on the battlefield 31 is presented on the CRT display 50 through link 47. The crew chief 55 directly views the digitized and highlighted enemy targets on the screen of the CRT. An output from the CRT 50 is fed to keyboard 57 through link 51. The crew chief has the option of annotating other targets to be hit by the gunners by shinning the light from light pen 56 on the designated target on the screen of the CRT. Outputs from the CRT 50 are in the XY position. The designated target information is applied to keyboard 57 and by way of lead 53 to the enhancement and cueing circuit 48 of computer system 44. The target that may be designated by commands from the keyboard 57, such as TARGET X=a coordinate, and Y=a coordinate. Readout on the keyboard will indicate the XY position of the most recent target. The crew chief may also have the capability of zooming the picture on the screen of CRT 50, say from the 2,000 foot level of the ATV camera to 400 foot above ground level, to better inspect which may be a target, and then annotate that target by using light pen 56 and keyboard 57 as stated above. The crew chief may then view the CRT display after his target designating step to verify the new targets prior to informing the gunners to fire. Any desired targets to be hit are originally highlighted by the target cueing algorithms and may be, for example, by inserting the letter T at four edges of the target as shown in FIG. 4. The crew chief may insert the letter T at four edges of the annotated targets by using the light pen. The four target edges of the annotated targets are automatically found by the target extractor in the connected components portion of the target cueing alogrithms. The illustrations used herein for the ATV camera method of target acquisition, as shown by FIGS. 2 and 7, designate target 19 as being hit by the projected fire from the artillery battery 14. However, it should be understood that there may be many gunners that are operating many other arillery batteries 14 to hit many other targets that are selected when there is a need for doing so. There will be various digital maps created in the different explosive canisters, whether the canisters are artillery projectiles or missile munitions, by a direct connection to a canister on-board microcomputer on each of the projectile or munitions as shown by FIG. 18, and the lead from the computer system 44 to the microprocessor as shown by FIG. 3. The crew chief may assign a single target to each of a plurality of gunners or missiles. The operation of the ATV camera as shown in FIG. 5 is a variation of the operation that was shown with reference to FIG. 2. In this configuration, an auxiliary receiver 52 is used to receive time delayed data from the ATV 18 by radio link 35B and then send this information by radio link 35C to the crew chief 55. Also, altitude information of the ATV 18 is sent directly to the crew chief 55 by radio link 35A. Information supplied through radio links 35B and 35A may be respectively a "beeper" system and a simple atltude device that provides triangulation.

The block diagram of FIG. 6 illustrate in a flow chart block diagram manner the Phase II steps 22 as noted by FIG. 1. The CRT display 50 is in direct view of the crew chief. After the crew chief has annotated targets on the CRT 50 by use of the light pen, he then assigns the thresholds of targets selected and instructs the gunners by keyboard 57. The thresholds are the video levels where the target may be made one color (black) and the background made another color (white) to yield a binary image. The initial step in target handoff is by instructing the gunners through keyboard 57, for example, such as address: gunner 17; target T on four edges for tank; X=some coordinate Y=some coordinate; and thresholds=some voltage level between 0 and 1 volt. The crew chief normally communicates with the gunner by a low signal level radio link to establish information of the area locator "basket diameter." The thresholds of targets selected by the target cueing algorithms are indicated by block 62. Digital target maps, shown as block 64, are produced and are combined with the various target thresholds 62 along with the possible range and altitude data obtained by triangulation, as described with reference to FIG. 5 and represented by block 60, into maps and data information 66. The digital target maps are produced from the thresholded binary image and the XY location of the target. The thresholds are used by the explosive canisters microcomputer to obtain the same binary image as was achieved by the sensed image of the enemy targets. Using the maps and data information 66, the projectile is programmed with one of the many digital target maps as shown by block 68, and the gunner information 70 is produced and transmitted to the gunner. The on-board-microcomputer contains a RAM 90, in which the digital target map and the necessary thresholds are stored. The projectile is electrically coupled to the low signal level radio link before being loaded into the artillery cannon. When the targeting data arrives to a particular gunner, the digital target map is simultaneously programmed into the map storage RAM 90. The gunner information 70 may be transmitted by many means, such as visual display, radio link with the crew chief, etc and contains information such as gun alignment to obtain the area locator. The digital target map 64 is displayed in a multi-block section as shown by numeral 72. The simple digital map 72 may have zeros "0" representing white background, a square group of four ones "1" representing targets, and a square group of four asterisks representing an additional annotated target designated by the crew chief to a gunner. A digital target map may contain from 1,000 to 2,000 picture elements with each numeral or asterisk representing one picture element. Block 74 of FIG. 6 represents moving target vectors constructed by the automatic target cueing algorithms that are viewed by both the crew chief and by the projectile, or explosive canister, itself since the projectile has an identical imaging system as that in view of the crew chief. The analog sensed image of the scene is converted to digital by the analog to digital converter 84 shown in FIG. 18.

The programming data sent to block 68 may be sent through the same low signal level radio link that was used to assign a "basket diameter." A microcomputer in the projectile, or munitions, is used to retrieve this data from maps and data 66 by the radio link and physically program the data into the canister. The microcomputer may be a standard integrated circuit programmed to digitize the sensed analog image obtained by what the camera views, to rotate the sensed image to perform map matching with the stored digital map, and retrieve this map from a data link and program it into its memory before canister launch. A miniature computer system that is identical to computer system 44 is in place, i.e. on-board, each projectile. Computer 44 may be a minicomputer or large computer that is able to perform all the present functions required of an artillery designator system, i.e. assign gunners, calculate XY target positions and gun tube angle, retrieve and store information from forward observers, etc. Computer 44 must also be able to manipulate stored target images as retrieved from the parachuted projectile or from a sensor platform of an aircraft, form target cued images and digital maps, and forward such maps and thresholds to the appropriate gunners. The microcomputer in the shell is only required to form a binary, i.e. threshold, image from the sensed image scene and to perform map matching with the stored digital template map. Any mismatch of the maps after the explosive canister is fired will cause air brakes or fins on the outer surfaces of the canister to move so as to correct the canisters to the target location.

Look now at FIGS. 8 through 22, and FIG. 3, along with the block diagram of FIG. 6 for an explanation of the imagery information processing and any manipulation by the man-in-the-loop, of the cued-on-clutter, etc that produces the digital target maps. Previous automatic systems that did not use the man-in-the-loop for target designating by either the light pen 56 on the CRT 50 or programming by use of keyboard 57 were found to be only 50% as efficient in finding and classifying target like objects as the present man-in-the-loop operation. FIGS. 8 and 9 indicate methods of forming a simple histogram to determine the video levels (thresholds) to separate objects and backgrounds to create the binary image. FIG. 8 illustrates target cueing that involves finding the numeral count of gray levels of objects on the background and/or valley seeking a histogram of all gray levels of the artillery TV image (or window under investigation) over an image total dynamic range. FIG. 9 shows the thresholded image curves between the target region and background region by comparing the edge levels with gray levels. The edge levels have the same range as the gray levels but represent the amount of transitions between two PIXELs rather than each of its discrete values. After finding the thresholds, wherein if a PIXEL is above the threshold, the color is white, but otherwise the color of the PIXEL is black, a binary picture of black on a white background may be formed. A shrink-expand method may be performed upon the image to eliminate noise. The next step is to perform connected components on the picture image to find objects of a certain size wherein the certain size being found is proportioned to the target type and the range in question. From the resulting binary picture, a digital target map may be produced where a plurality of black targets are present on a white background.

Figure 10:
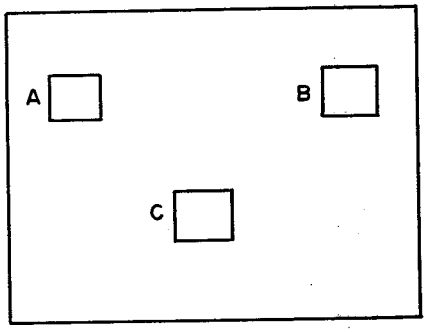
FIG. 10 illustrates an example block representation of an actual image that the ATV camera sees in flight.
Figure 11:
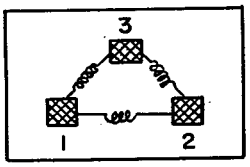
FIG. 11 illustrates a spring loaded template map that is stored in the memory of the microcomputer on-board the projectile.
Figure 12:
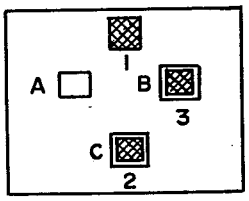
FIG. 12 illustrates a case where the microcomputer within the projectile has rotated the spring loaded template map of FIG. 11 clockwise through one quarter turn.
Figure 13:
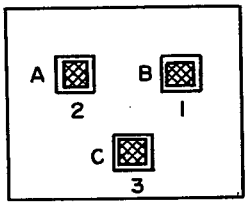
FIG. 13 illustrates a case where the microcomputer has rotated the spring loaded template map of FIG. 11 through one half turn clockwise and is matched to the actual image as presented in FIG. 10.

FIG. 10 is representative of an actual image that the TV 18, or sensor platform, transmits back to the image processing computer system shown in FIG. 3 and to the microcomputer and peripheral equipment in the explosive canister as shown in FIG. 18. FIG. 11 illustrates a digital target map automatically stored in RAM 90 of one of the canisters by the image processing computer system. The programmed canister may then be fired toward one or more of the targets, A, B, and C as shown in FIG. 10. However, the digital map spring loaded templates having targets 1, 2, and 3 burned therein have the targets mismatched. Therefore, the microcomputer within the canister is programmed in program storage random access memory 90 to rotate the spring loaded template through first 90° then 180° as shown in FIGS. 12 and 13 respectively until there is a match between. The springs are not shown in FIGS. 12 and 13 but in FIG. 12 the springs would be stretched. In FIG. 13 the actual image targets A, B, and C have the spring loaded template targets 1, 2, and 3 matched thereto and all springs would be stretched the same amount. The canister is guided by the guidance system 92 of FIG. 18 to keep this combination matched until one of the designated target is hit by the explosive canister.

The spring loaded template is simply the stored digital map with XY distance (oblique distance) between the objects being the length of the "spring." Stretch in the springs is the amount of distortion the template must suffer to achieve a good fit with the sensed target image. The templates are rotated mathematically by a program stored in a program storage memory read only memory (ROM) within the minicomputer when performing map matching. As a specific example, a stored digital target map may have three objects burned therein where one of the objects is at PIXEL coordinates X=1 and Y=1, a second object is at X=512 and Y=1, and a third object is at X=256 and Y=256. The sensed image from the TV camera or sensor platform may have three targets wherein one target is at X=256 and Y=1, a second target at X=1 and Y=512, and a third target X=512 and Y=512. With the situation existing the three targets are 180° out of phase with the three objects stored in the digital map template. As mentioned above, the template is rotated mathematically in the ROM by the on-board microcomputer until the template objects match the sensed image targets. It should be noted that many other digital template maps are originally produced such that matching of any combination of targets may be made with one of the originally produced digital template maps whereupon outputs from the template maps help guide the artillery projectile to a selected target.

Figure 15:
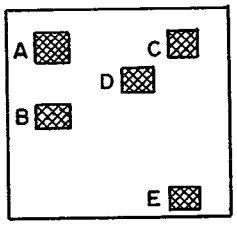
FIG. 15 represents a sensed image that the ATV camera sees in flight.
Figure 16:
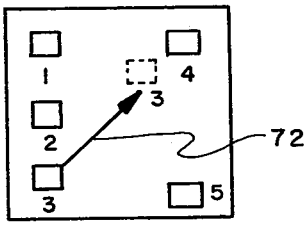
FIG. 16 shows an "all but one" theory of a moving target vector wherein 3 is moved from where D was in the actual image of FIG. 15.

FIG. 14 illustrates, as an example, a digital target map that is programmed in a projectile in which numeral 71 indicates a target moving vector within the digital map. FIG. 15 shows an actual image that the projectile sees in flight. The moving target vector does not necessarily appear on the cathode ray tube. Rather, it appears in the digital map as either another set of characters or as a mathematical representation in a look-up table. FIG. 16 illustrates a digital target map on the cued-on-clutter of the image that is taken from FIG. 15. The microcomputer in the projectile is programmed to mathematically move target 3 of the digital map to a position in which there will be no stretch in the spring when compared with the sensed image of FIG. 15. The phenomenon shown in FIG. 16 is known as the "all but one" theory since objects 1, 2, 4, and 5 remain in the same place while target 3 is moved along the moving target vector 72. It should be noted that the example as shown in FIG. 14 wherein after the digital map template has been burned in the projectile, the target as shown at coordinates 4A moves along target vector 71 through coordinates 5B, 6C, and 7D. The same basic cued-on-clutter operation works for the moving target vector maps. That is, the digital map uses templates which contain targets and clutter objects to find a target by its relation to other objects in the sensed image scene. The system keeps analyzing various objects to find the one most like a stored target description in the digital target map.

Since the ATV takes several frames over the same area during its descent, an observer can see if an object moves relative to other stationary objects in the scene, such as bushes and rocks. The crew chief can calculate the speed and direction of the moving vehicle and indicate that information by placing a moving target vector, such as 71 in FIG. 14, over the screen of the CRT 50 for transposition to the digital map RAM 90. Preferably, the moving target vector 71 is marked by the crew chief as asterisks in coordinates 5B, 6C, and 7D. When performing automatic target cueing, a number of nontargets (rocks, bushes, etc) will be segmented (threshold) out and identified as targets. This is inherent of the system accuracy. Most system designers attempt to limit or reject as many of these false alarms as possible. Since the proposed system contains a main-in-loop who identifies the target to be engaged (using the light pen) there is a small chance that clutter will be mistaken for the target. Since clutter does not move, the system can use these items as references in locating the desired target. Hence attempts to reduce clutter will be avoided since this increases the number of references available to the pattern matching routines. This will permit more exact fits which will yield more accurate target locations.

The canister programming steps, including the storage of digital target maps and the indication to the gunner or to the missile munitions of the area locator where a single target is designated are as follows. Only the crew chief receives the ATV 18 images during the step of receiving the TV imagery information during phase I. The same low signal level radio link used between the crew chief and the gunner is also used in the steps of designating a single target and assigning a gunner and to pass the data to program the projectile, i.e. the step of creating the digital target map. In the step of creating the digital target map, a read-only memory (ROM) chip is placed in a holder within the shell, or projectile, to be fired in which there is excess voltage available on the chip. By the radio link, which is also attached to the ROM chip in the projectile, the crew chief passes the data to program the microcomputer in the projectile. After the projectile is programmed, the gunner or a member of the gun crew places the programmed projectile in the gun. The programmed projectile is fired toward a coordinate of the established coordinate system is also the area locator assigned by the crew chief. It should be noted that the cued-on-clutter step uses a digital target map, within the ROM chip, which contain targets and clutter objects to find a target by its relation to other objects in the scene in the picture window of ATV 18. The microcomputer in the projectile keeps analyzing the various objects in the sensed image scene observed the ATV 18, and is transmitted to the projectile imaging system, to find the one most like the description of the stored digital target. It should also be noted here that the thresholding step of the cued-on-clutter step is only done by the crew chief prior to the digital map being burned in the ROM chip of the projectile microcomputer. The microcomputer in the projectile then uses the digital target map for target (pattern) matching or spring loaded template rotating to best match the actual image from the projectile imaging equipment.

As stated above, the purpose of the ATV or the airborne sensor platform imaging system is to eliminate the forward observer by using mapping techniques to calculate target position from the return sensed images. A problem that exists is that even though the exact position where the parachute opens is known, no computer can predict drifting (due to wind) or updrafts (due to thermals) to establish a reference with the ground. The present method eliminates the need for a ground reference since the gunner fires the explosive projectile canister to the same place he fired the ATV. The "smarts" in the projectile guide to the proper target using the stored pictures.

Phase III is described with reference to FIG. 7. The projectile programming step is shown by heavy arrows as coming from the crew chief van 15 and going to the artillery battery 14, or specifically to one of a plurality of projectiles. The gunner information is sent to a gunner who operates the artillery battery 14 by firing the projectile in a direction known as a "basket diameter." The projectile travels along the projectile launch path 39 to hit designated target 19. The projectile first travels through the ballistic path A in a ballistic trajectory, then travels through the area correlator path B, and onto the target homing cuer path C to target 19 where the microcomputer controls the guidance of the projectile. The projectile may be guided to target 19 by extension of air brakes and airborne guiding means, such as fins, to glide and brake the projectile into the target. The air brakes and airborne gliding means are controlled according to the difference in the match of the digital target map and the sensed image. The air brakes and airborne gliding means may also be controlled by solid state metallic detectors that sense the tanks or trucks at about 400 meters above ground level. The digital map, burned in the nose of the projectile, locates stationary targets and highlights moving targets by the digital target map mentioned herein above. The digital target map is comprised of cued targets attached by imaginary "springs" between the targets. The stretch in the springs indicates the degree of fit between the burned digital target map and the image from the battlefield area 31. The moving targets are then found by the "all but one" fit of the spring, i.e. one spring is being stretched. It should be noted that the airborne gliding means and air brakes must operate fast enough to compensate for any projectile spin. However, the projectile is not spinning as it exits the gun barrel since the projectile is mounted on roller bearings that are thrown off the side of the projectile immediately after launch.

It is contemplated that multiframe averaging of the TV picture may be used in the future to achieve better contrast resolution. Also, infrared imagery, such as pyroelectric vidicons, charge-coupled device TV imaging systems, staring IR arrays or reticulated isocon read-out devices of the TV imaging systems may be used.

I claim:

1. A method of autonomous target acquisition for an imaging self guided explosive canister launched by a millitary battery, comprising the steps of:

exposing an active sensor imaging system on a sensor platform to a direct view of an enemy area of a battlefield to obtain a sensed image and transmitting said sensed image therefrom;

receiving said sensed image in a TV receiver of an image processing computer system and converting the sensed TV image from analog to digital while performing enhancement and target cueing algorithms on said sensed TV image and displaying the enhanced targets in digital form on a light sensitive screen of a cathode ray tube;

performing a manipulation of the digitized information on the light sensitive screen by a crew chief man-in-the-loop viewing the sensed TV image display and annotating selected targets to be hit by said military battery imaging self guided explosive canister by a light pen light beam means and manipulation of said image processing computer system which is electrically connected with an on-board microcomputer system within each of a plurality of imaging self guided explosive canisters to assign a specific imaging self guided explosive canister to a specific target wherein said image processing computer system automatically provides said microcomputer with a digital target map of the sensed TV image including the crew chief manipulated annotated target;

launching said imaging self guided explosive canister toward the battlefield enemy area while unshielding a canister active imaging system wherein said canister active imaging system provides said microcomputer system with a continuous sensed image picture of said enemy area; and automatically sequencing a program stored within said microcomputer system for matching said digital target map to said continuous sensed image by rotating said digital target map using mathematical algorithms to match said annotated target to its spatial position of said continuous sensed image picture of said enemy area and after the matching step is complete activating a terminal guidance system for autonomous guidance of said canister to said annotated target.

2. A method as set forth in claim 1 wherein the step of performing target cueing algorithms on said sensed TV image is further comprised of the steps of receiving the sensed TV imagery and comparing the images separated in time to find the threshold of the images and to create a binary image where the background is one color and the targets on the background are another color and calculating the bounds of individual targets by connected components and classifying targets according to a preprogrammed class of enemy target size and shape to produce a digital target map and highlighting the classified target by placing highlighter graphic markers at the classified target to draw the attention of the crew chief to the classified object wherein the crew chief visually determines if classified targets are enemy targets to be destroyed and annotates one of said targets by said light beam means wherein said annotated target and said sensed image are fed to a canister on-board microcomputer system as a digital target map by the electrical connection between said image processing computer system and said microcomputer system.

3. A method as set forth in claim 2 wherein automatically sequencing a program stored within said microcomputer system is comprised of the steps of originally storing said digital target map in a digital map storage RAM and breaking electrical connection with said computer systems upon launching said canister and then receiving a digitized image of said continuous sensed image that has been converted from analog to digital by analog to digital converter means and temporarily storing said digitized sensed image in an image storing RAM and retrieving the segmentated threshold values and target connected components with moving target vectors of the digital target map from said digital map storage RAM and performing the steps of matching said digital target map with said digitized sensed image by rotating said digital target map by using said mathematical algorithms that are stored in the program that is automatically sequenced to match said digital target map to said digitized sensed image and determines that guidance commands be sent to a guidance system according to the match of said annotated target with said digitized sensed image.

4. A method as set forth in claim 3 wherein said step of crew chief manipulation of said image processing computer system is by annotating a target which was not segmented out and classified as targets by performing the target cueing algorithms but was by first a visual inspection by said crew chief to determine an enemy position wherein said manipulation is by designating a target point referenced to clutter in said digital target map.

5. A method as set forth in claim 4 wherein the step of matching said digital target map with said digitized sensed image is by matching a plurality of small thresholded windows within said digital target map and said digitized sensed image.

6. A method as set forth in claim 4 wherein beginning with the step of exposing an active sensor imaging system on a sensor platform through the step of launching said canister is by using an advanced attack helicopter with a sensor platform thereon for sighting enemy targets wherein said helicopter operates at treetop level or behind same natural obstacle and pops-up to take one frame of a sensed image of the enemy area into the image processing computer system in which said crew chief freezes the one frame on said CRT for visually determining if an enemy target is present and annotating said target wherein the digital target map is furnished by a data link electrical connector to said digital map storage RAM in said microcomputer system in an imaging missile munitions canister and a launching operation is started wherein said helicopter pops-up in view of the enemy target area and said imaging missile munitions canister is launched toward the target as annotated by the crew chief whereupon said step of automatically sequencing a program stored within said microcomputer system begins operation to guide said imaging missile munitions canister to said annotated target.

7. A method as set forth in claim 6 wherein the step where the launching operation is started comprises the helicopter remaining popped down behind said natural obstacle and said imaging missile munitions canister launched in the direction toward said annotated target wherein said imaging missile munitions canister has the capability programmed therein for diverting said canister over said obstacle and tilting said canister over toward the enemy area whereupon said step of automatically sequencing a program stored within said microcomputer system begins operation to guide said canister to said annotated target.

8. A method as set forth in claim 4 wherein the steps of exposing an active sensor imaging system on a sensor platform through the step of launching said canister is by the steps of:

launching a picture transmitting artillery TV from an artillery battery over an enemy battlefield area wherein said artillery TV has a parachute attached thereto that is deployed therefrom for slowly descending toward the enemy battlefield;

firing gunner spotter rounds from a plurality of artillery batteries to coordinate all of said artillery batteries to a central reference;

receiving the continuously transmitted sensed image pictures of the enemy battlefield in the image processing computer system wherein the crew chief assigns a gunner to each of the annotated targets by indicating an area locator basket diameter within said central reference and according to the number of annotated targets a digital target map is furnished by a data link electrical connector to said digital map storage ROM in each of said microcomputer system in an imaging self guided artillery projectile canister wherein each of said imaging self guided artillery projectile canister is launched into one each of said locator basket diameters by said gunner whereupon the step of automatically sequencing a program stored in each microcomputer system begins operation to guide each of said imaging self guided artillery projectile canister to its respective annotated target.

9. A method as set forth in claim 8 wherein said step of firing gunner spotter rounds comprises firing cloud charges.

10. A method as set forth in claim 9 wherein the step of firing gunner spotter rounds further comprises locking an offset into each artillery battery so that the crew chief simply relays the point of impact as viewed by said image processing computer system to each gunner regardless of the position of the gunner.

* * * * *